US010930990B2

(12) United States Patent
Seebacher et al.

(10) Patent No.: US 10,930,990 B2
(45) Date of Patent: Feb. 23, 2021

(54) DEVICE HAVING AT LEAST ONE SUBSET OF STRIPLINE SECTIONS ON OPPOSITE SIDES OF AN ELECTRICALLY CONDUCTIVE STRUCTURE AND CONFIGURED TO HAVE POSITIVE COUPLING

(71) Applicant: Infineon Technologies AG, Neubiberg (DE)

(72) Inventors: David Seebacher, Villach (AT); Andrea Del Chiaro, Villach (AT); Christian Schuberth, Villach-Landskron (AT); Peter Singerl, Villach (AT); Ji Zhao, Villach (AT)

(73) Assignee: INFINEON TECHNOLOGIES AG, Neubiberg (DE)

( * ) Notice: Subject to any disclaimer, the term of this patent is extended or adjusted under 35 U.S.C. 154(b) by 14 days.

(21) Appl. No.: 16/277,398

(22) Filed: Feb. 15, 2019

(65) Prior Publication Data

US 2019/0280360 A1 Sep. 12, 2019

(30) Foreign Application Priority Data

Mar. 8, 2018 (DE) ..... 10 2018 105 349.5

(51) Int. Cl.

| | |
|---|---|
| ***H01P 3/08*** | (2006.01) |
| ***H01P 3/16*** | (2006.01) |
| ***H01P 5/02*** | (2006.01) |
| ***H01P 9/00*** | (2006.01) |

(52) U.S. Cl.

CPC ..... *H01P 3/088* (2013.01); *H01P 3/08* (2013.01); *H01P 3/082* (2013.01); *H01P 3/16* (2013.01); *H01P 5/028* (2013.01); *H01P 9/006* (2013.01)

(58) Field of Classification Search

CPC ..... H01P 9/006; H01P 5/028; H01P 3/082; H01P 3/088; H01P 5/184; H01P 5/185; H01P 5/187; H01P 3/026; H01P 3/04

USPC ..... 333/33, 246

See application file for complete search history.

(56) References Cited

U.S. PATENT DOCUMENTS

| | | | | |
|---|---|---|---|---|
| 4,494,083 | A * | 1/1985 | Josefsson et al. | H01P 3/085 333/238 |
| 5,369,379 | A * | 11/1994 | Fujiki | H01P 5/185 333/116 |
| 5,917,388 | A | 6/1999 | Tronche et al. | |
| 6,031,445 | A | 2/2000 | Marty et al. | |
| 2003/0030994 | A1 * | 2/2003 | Takaya et al. | H01P 5/187 361/728 |
| 2011/0006861 | A1 | 1/2011 | White et al. | |

(Continued)

*Primary Examiner* — Benny T Lee

(74) *Attorney, Agent, or Firm* — Slater Matsil, LLP

(57) ABSTRACT

A device includes at least one electrically conductive structure and at least one stripline. The stripline includes stripline sections that are connected to one another in a series connection between a first terminal and a second terminal. A first subset of the stripline sections is arranged on a first side of the conductive structure and a second subset of the stripline sections is arranged on a second side of the conductive structure. The device also includes at least one conductive connection between the first subset of the stripline sections and the second subset of the stripline sections, wherein the at least one conductive connection is isolated from the at least one electrically conductive structure.

18 Claims, 11 Drawing Sheets

(56) References Cited

U.S. PATENT DOCUMENTS

2011/0279190 A1* 11/2011 Liu et al. ..... H01P 5/028
333/35

* cited by examiner

DEVICE HAVING AT LEAST ONE SUBSET OF STRIPLINE SECTIONS ON OPPOSITE SIDES OF AN ELECTRICALLY CONDUCTIVE STRUCTURE AND CONFIGURED TO HAVE POSITIVE COUPLING

This application claims the benefit of German Application No. 102018105349.5, filed on Mar. 8, 2018, which application is hereby incorporated herein by reference.

TECHNICAL FIELD

This disclosure relates in general to devices having stripline sections.

BACKGROUND

Developments in the field of radiofrequency (or RF) applications, for example in the case of communications systems, are increasingly moving in the direction of smaller dimensions with simultaneously higher power and with the simultaneous requirement of satisfying larger bandwidths of the signals. In order to keep the spatial requirements of corresponding RF circuits compact, the degree of integration of the RF circuits is successively increased. This also applies to the dimensions of RF circuits that comprise waveguides, typically consisting of two transmission lines, wherein the two transmission lines are often configured as what are called striplines.

In order to keep the dimensions of these striplines compact, for example to keep the requirements in terms of the amount of surface on a circuit board low, striplines are often configured in a snaking form, which is often also referred to as being meandering. This snaking allows a more compact arrangement than a straight stripline configuration, but, as a result of the close spatial arrangement of stripline sections, electromagnetic coupling of different, for example adjacent, stripline sections may occur, which may result in undesired effects. For example, it is possible for this type of electromagnetic coupling to change the effective electrical length of the transmission line for certain signals, and losses may increase in the transmission line.

These possible negative effects due to electromagnetic coupling are called "negative feedback" between stripline sections.

SUMMARY OF THE INVENTION

According to one exemplary embodiment, a device is provided that comprises at least one electrically conductive structure and at least one stripline. The stripline comprises a multiplicity of stripline sections that are connected to one another in a series connection between a first terminal and a second terminal. A first subset of the stripline sections is arranged on a first side of the conductive structure and a second subset of the stripline sections is arranged on a second side of the conductive structure, wherein the second side is different from the first side. Furthermore, the at least one conductive connection is isolated from the at least one electrically conductive structure, wherein the first subset of the stripline sections is arranged in a first arrangement and/or the second subset of the stripline sections is arranged in a second arrangement, such that a signal propagating from the first terminal to the second terminal has coupling integrated over the first arrangement and/or second arrangement, which coupling is positive.

BRIEF DESCRIPTION OF THE DRAWINGS

FIG. 1*a* shows a plan view, and FIG. 1*b* shows a cross-sectional view;

FIG. 3*a* shows a plan view, and FIG. 3*b* shows a cross-sectional view;

FIG. 5*a* shows a plan view, FIG. 5*b* shows a cross-sectional view, and FIG. 5*c* shows a perspective view;

DETAILED DESCRIPTION OF ILLUSTRATIVE EMBODIMENTS

Figure 1A:
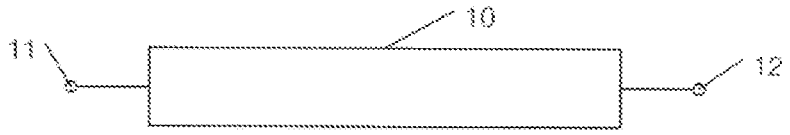
FIGS. 1*a* and 1*b* schematically show a waveguide that is implemented by way of striplines, as is used in exemplary embodiments.

Various exemplary embodiments are described in detail below with reference to the appended drawings. These exemplary embodiments should be considered merely as an example and should not be understood to be restrictive. Byway of example, in other exemplary embodiments, some of the described features or components may be omitted and/or replaced with alternative features or components. Features or components of various exemplary embodiments may be combined in order to form further exemplary embodiments. Variations and modifications described with regard to one exemplary embodiment may also be applied to other exemplary embodiments. Furthermore, features or components other than those described or shown may be provided, for example in conventional transmission line circuits or circuits used in connection with radiofrequency (RF) technology. By way of example, RF technology is used in the frequency range of fifth generation (5G) mobile radio networks.

Direct connections or couplings shown in the drawings or described below, that is to say electrical connections or couplings without interposed elements (for example simple metal conductive tracks) may also be produced by way of an indirect connection or coupling, that is to say a connection or coupling that comprises one or more additional interposed elements, and vice versa, as long as the general function of the connection or coupling, for example providing a voltage, providing a current, guiding an electromagnetic wave or providing a control signal, is substantially retained.

In the figures, identical reference symbols indicate identical or similar elements. The figures are schematic representations of various exemplary embodiments. Elements that are illustrated in the figures are not necessarily illustrated true to scale. Rather, the various elements that are illustrated in the figures are reproduced in such a way that their function and general purpose become clear to a person skilled in the art.

Numerical values cited in connection with exemplary embodiments, for example in connection with simulation curves, serve merely for the purpose of explanation. Numerical values and profile forms of curves should not be interpreted as being restrictive and depend on the choice of the parameters.

Waveguides, for example RF waveguides, may be implemented in various ways. By way of example, waveguides may be implemented by way of two striplines. Striplines may be conductive track sections. Conductive track sections illustrated as simple rectangular conductive track sections may have more complex shapes, as is known for striplines in RF technology, such that for example capacitive and inductive effects are able to be created by suitably dimensioned strips and, through suitable shaping, filter structures or the like are also able to be produced.

Striplines may be configured so as to run in planes, but also over curved surfaces.

Striplines may be used to implement waveguides. To this end, a first conductor element may comprise one or more striplines. This stripline may be applied to a dielectric. A second conductor element may be configured as a stripline, which may be configured for example as a conductive surface. This second conductor element may be at a reference potential, which may be a ground potential, and be isolated from the first conductor element. Further examples of striplines are described in connection with FIGS. 1*a* and 1*b*.

Figure 1B:
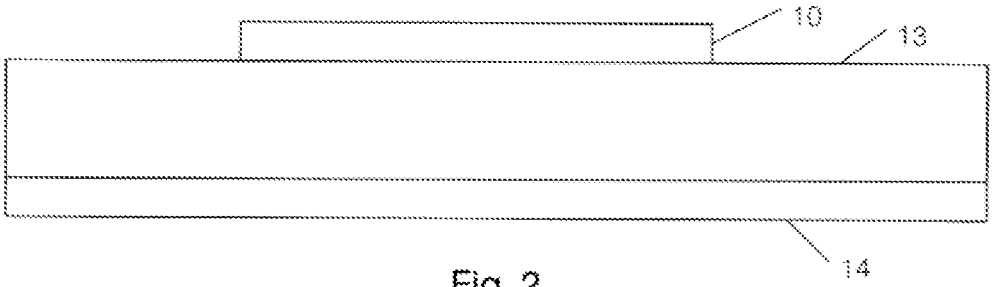

FIGS. 1*a* and 1*b* schematically show a waveguide that is implemented by way of striplines, as is used in exemplary embodiments. FIG. 1*a* shows a plan view, and FIG. 1*b* shows a cross-sectional view.

The waveguide that is shown is suitable for transmitting a signal, for example an RF signal, from a first terminal 11 to a second terminal 12 as shown in FIG. 1*a*. The waveguide of FIGS. 1*a* and 1*b* comprises, as a transmission line, a stripline 10, which may be arranged for example as shown in FIG. 1*b* on a dielectric 13 above a conductive structure 14 that is at a ground potential. The conductive structure 14 may in this case be used as a second transmission line. The conductive structure 14 may likewise be configured as a stripline. Numerous parameters, such as for example the frequency of the wave, the desired transmission behavior, for example the impedance between the first terminal 11 and the second terminal 12, and the geometric dimensions of the stripline 10 and of the conductive structure 14 and properties of the dielectric 13 influence the design of the geometry, for example in terms of length, width and height of the stripline 10.

To achieve desired transmission properties for HF signals between the first terminal 11 and the second terminal 12, it may be necessary to route the stripline 10 over a relatively long path, which may go against the requirement of compactness for some cases of application.

The striplines, for example the stripline 10 and the conductive structure 14, may be striplines in general, but also within the meaning of the term "microstrip", as an arrangement on the surface of an insulating plate, for example a ceramic material. The striplines may be configured symmetrically but also asymmetrically, for example in the form of what is called an "offset stripline."

Surfaces or planes that are discussed below may be implemented in the form of multilayer substrates. In the case of multilayer substrates, layers other than those shown in the exemplary embodiments may be used. By way of example, additional dielectric layers and metal layers may be used. These metal layers may be used for example to shield the exemplary embodiments.

In the context of this description, electromagnetic coupling or counter-induction is understood to mean the mutual electromagnetic influencing of two or more spatially adjacent conductive components due to electromagnetic induction. In terms of quantity, the electromagnetic coupling or counter-induction may be described with the aid of coupling coefficients.

By way of example, electromagnetic coupling may also exist between stripline sections. If these striplines or else also other conductive structures are used to transmit signals, the interaction due to the electromagnetic coupling of individual sections of the structures may influence the waveguide properties of the conductively connected overall structure. Depending on the type of electromagnetic coupling, this coupling may have an advantageous effect with regard to the desired routing properties for the RF signals. Accordingly, positive coupling then exists if signals are amplified due to the coupling interaction, which leads to a situation whereby the attenuation of a signal in a matching path comprising series-connected stripline sections is reduced in comparison with a matching path configured so as to be straight. Accordingly, negative coupling (which is disadvantageous for some applications) then exists if the interaction of the signals leads to weakening, which leads to a situation whereby the attenuation of a matching path is increased in comparison with a matching path configured so as to be straight. For an arrangement of stripline sections that are connected in series, an integrated coupling may be determined, wherein the coupling coefficients for the various regions are discretely summed or integrated in order to determine an integrated coupling of a signal. The coupling, integrated over an arrangement of stripline sections, may be determined for example on the basis of the geometry by way of numerical methods. In this case, the integration may be numerically approximated.

A direction, in connection with this description and unless stated otherwise, is understood to mean a vector value. Directions may thus differ by 180°, for example. If the underlying surface with respect to which the direction is given is a plane, angular relationships between the directions may be determined by way of calculations in Cartesian coordinates; otherwise, conformal maps such as for example Mercator projections may be used.

The term "substantially parallel" is understood to mean that two directions deviate from one another by a maximum of ±20°, for example by a maximum of ±15°, for example by a maximum of ±10°, for example by a maximum of ±5°, for example in the context of the manufacturing tolerance of the respective manufacturing method. If a direction of a curved form or of a form having a complex profile is involved, then the underlying direction should be determined using the start and end point of the corresponding structure. By way of example, structures may have a direction in that they follow an underlying direction in substructures that are configured in steps. To this end, structures may be composed for example of substructures that are each arranged at an angle of 90° with respect to one another, for example, and extend over various lengths of the respective substructures taken together in any desired predefined direction. In the case of substructures that are configured in steps, a parallel profile may for example also be achieved by the individual substructures, or at least some of the substructures, being arranged parallel to one another.

Figure 2:
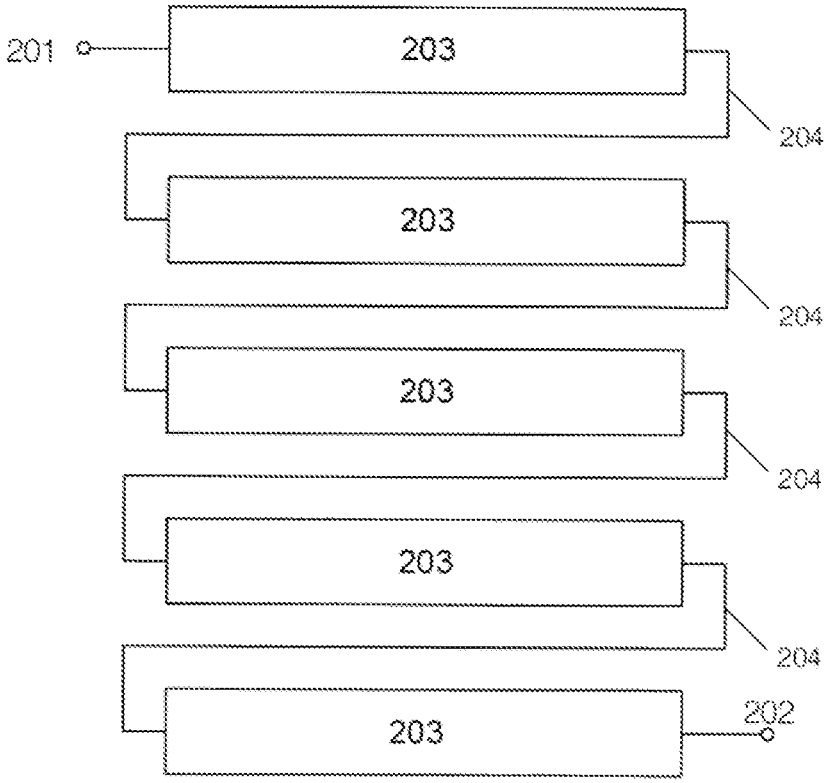
FIG. 2 schematically shows one possible implementation according to various exemplary embodiments.

FIG. 2 schematically shows one possible implementation according to various exemplary embodiments.

FIG. 2 schematically shows a plan view of a transmission line of a stripline. The signal is in this case routed from a first terminal 201 to a second terminal 202. The transmission line configured as a stripline is composed of a multiplicity of stripline sections 203, 204. A first subset of the stripline sections 203 are arranged here in an S-shaped arrangement in the plane that is shown, such that adjacent striplines of the first subset of the stripline sections 203 route the signal in the same direction, which may lead to positive coupling of the signals in the various stripline sections 203. A second subset of the stripline sections 204 form the stripline sections 204 that provide feedback. These are arranged here such that negative coupling between the stripline sections 204 that provide feedback and the stripline sections 203 is avoided. This is able to be achieved by at least one electrically conductive structure being present between the first subset of the stripline sections and the second subset of the stripline sections. The spatial separation of the first and second subsets of the stripline sections is indicated here by the different drawing of the stripline sections 203 and 204. Depending on the configuration, positive feedback between the stripline sections 204 that provide feedback may likewise be possible. This may be achieved for example by a substantially parallel arrangement of the respective striplines. In some exemplary embodiments, with respect to a first subset of stripline sections and/or a second subset of the stripline sections, a proportion of more than 30%, for example more than 50%, for example more than 70%, with respect to an overall length of the multiplicity of stripline sections between the first terminal 201 and the second terminal, may have positive coupling.

Due to the positive feedback between the various stripline sections 203, in some embodiments, it may be possible to use wider and at the same time shorter striplines, in comparison with the stripline dimensions in the case of an uncoupled transmission line. As a result, such a structure may have lower losses and at the same time be suitable for more compact structures due to the changed electrical length.

Figure 3A:
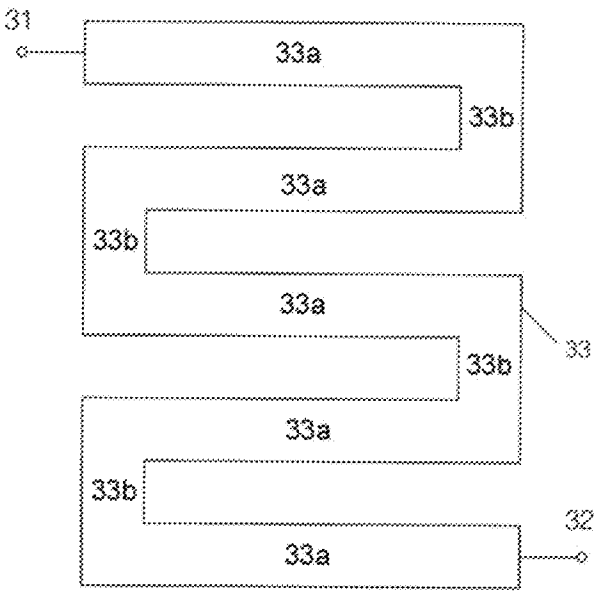
Fig. 3a RELATED ART
FIGS. 3*a* and 3*b* schematically show a snaking transmission line as a comparative example with respect to FIG. 2.
Figure 3B:
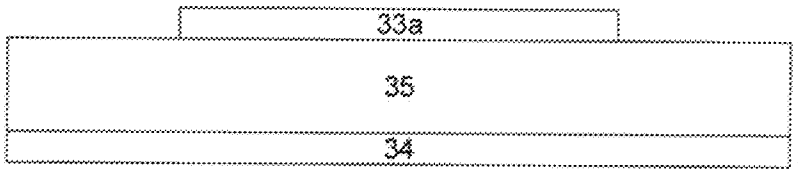
Fig. 3b RELATED ART

FIGS. 3*a* and 3*b* schematically show a snaking transmission line as a comparative example with respect to FIG. 2. FIG. 3*a* shows a plan view, and FIG. 3*b* shows a cross-sectional view.

FIGS. 3*a* and 3*b* show, as a comparative example, a waveguide comprising a first transmission line, which is configured as a stripline 33 (FIG. 3*a*) comprising a plurality of stripline sections 33*a*, 33*b*, and a second transmission line, which is configured as shown in FIG. 3*b* as a stripline 34, wherein a dielectric 35 is situated between the two transmission lines.

The stripline 33 connects a first terminal 31 to a second terminal 32, as shown in FIG. 3*a*. The stripline 33 is configured so as to be snaking (meandering) here and is composed of stripline sections 33*a* that run in a first direction and stripline sections 33*b* (FIG. 3*b*) that run in a second direction. As a result of this configuration described immediately above, it may be possible to satisfy the requirements mentioned in connection with FIG. 1 in terms of a more compact surface. One disadvantage of this structure in comparison with the exemplary embodiments mentioned in connection with FIG. 2 is that neighboring stripline sections 33*a* guide waves in opposing directions, and the waves may electromagnetically couple with one another on account of the spatial closeness.

These interactions may lead to disadvantageous properties as the waves flow in different directions. To compensate this effect and to have the same equivalent impedance and electrical length as a waveguide guided in a straight line, it may be necessary to modify the physical properties of the transmission line. The result of the design may be thinner striplines 33 having a longer overall length, which may in turn lead to higher losses in the line.

Figure 4A:
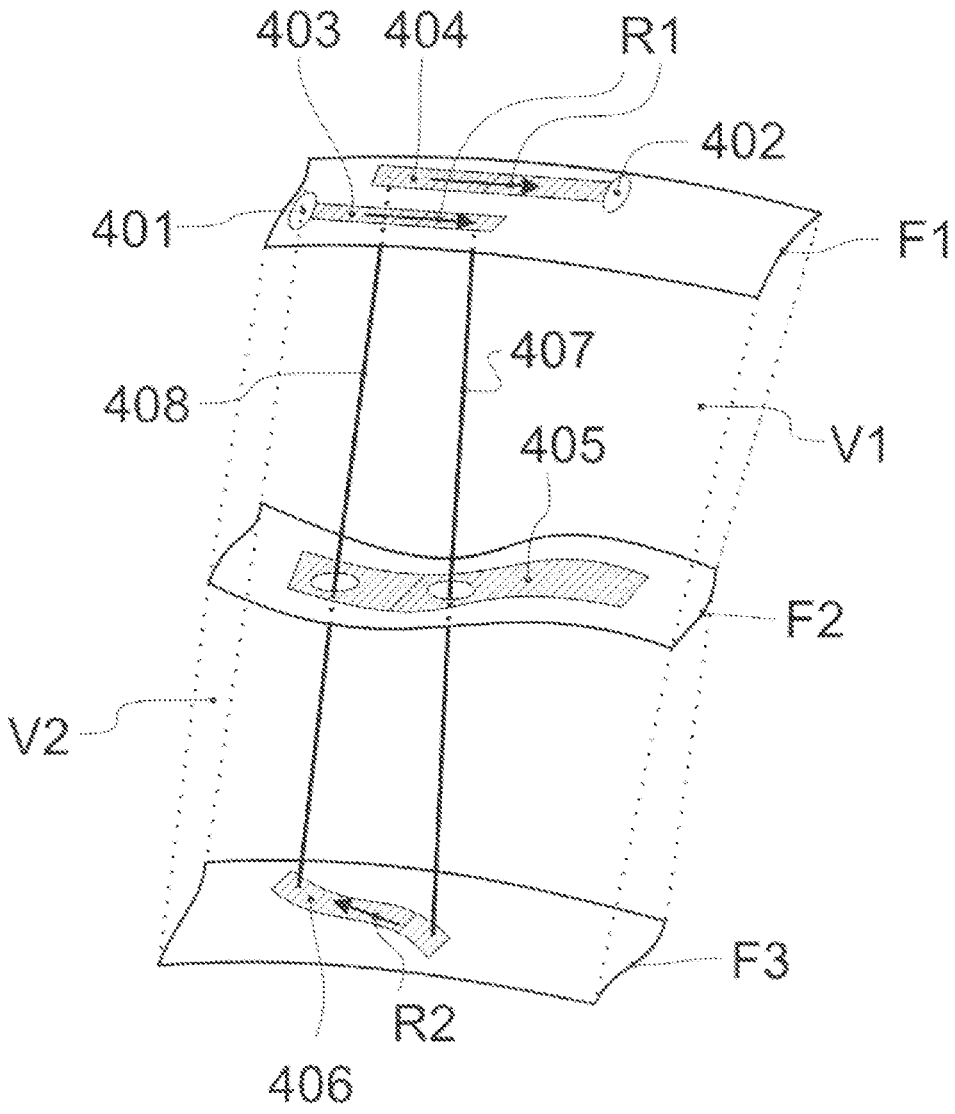
FIG. 4*a* schematically shows possible implementations according to various exemplary embodiments.

FIG. 4*a* schematically shows possible implementations according to various exemplary embodiments.

In the implementation shown in FIG. 4*a*, conductive structures, which may be stripline sections, are arranged on a first surface F1, a second surface F2 and a third surface F3. As indicated, the surfaces may be formed as desired, and may be flat planes or else complex shapes, for example curved or bent surfaces. In one implementation in semiconductor manufacturing processes, the surfaces F1, F2 and F3 may be process planes, for example metal planes. At least one electrically conductive structure 405 is arranged in the second surface F2. The at least one electrically conductive structure 405 may in this case be at a reference potential, for example ground. The at least one electrically conductive structure 405 may be configured as at least one stripline. A first volume V1 is situated between the first surface F1 and the second surface F2. This first volume V1 may be filled with a first dielectric having a permittivity ε1 (not shown). A second volume V2 is situated between the second surface F2 and the third surface F3. The second volume V2 may be filled with a second dielectric having a permittivity ε2 (not shown) that may have the same material or another material. Examples of materials are silicon oxide or silicon nitride.

Figure 4B:
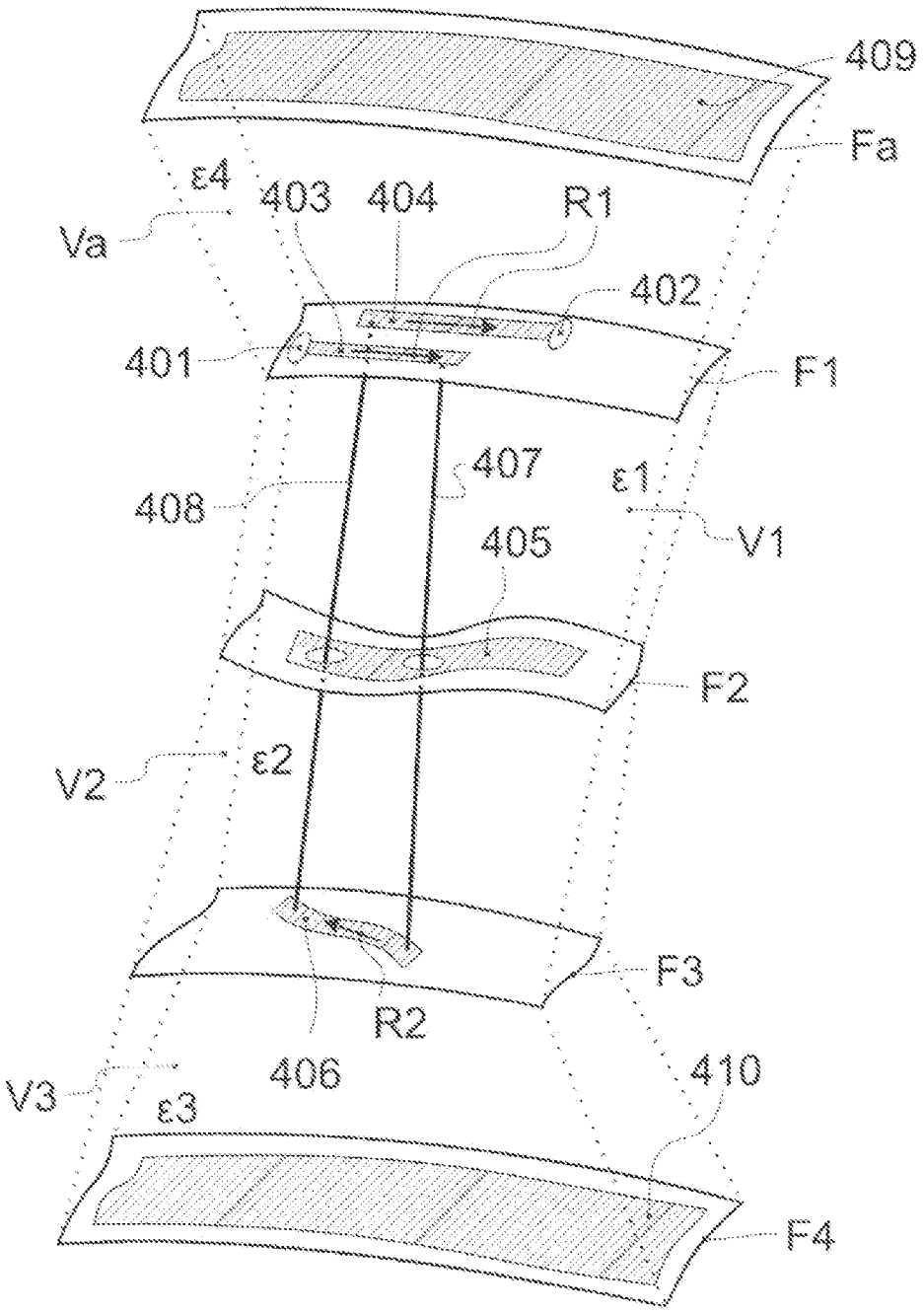
FIG. 4*b* schematically shows further possible implementations according to various exemplary embodiments of the exemplary embodiments of FIG. 4*a;*

The stripline sections 403 and 404, in the examples of FIGS. 4*a* and 4*b*, connect a first terminal 401 to a second terminal 402 and are composed of a first multiplicity of stripline sections 403, 404, which belong to a first subset of stripline sections 403, 404, which are arranged on the first surface F1 in the implementation in FIGS. 4*a* and 4*b*, and at least one second stripline section 406, which belongs to a second subset of stripline sections 406 and which is arranged on the third surface F3.

In some exemplary embodiments, the stripline sections have properties of the stripline 33 outlined in connection with FIGS. 3*a* and 3*b*.

At least one conductive connection 407, 408 is provided, which are produced by way of a multiplicity of connecting elements 407, 408 in the exemplary embodiment that is shown and connect the stripline sections of the first 403, 404 and second subset of the stripline sections 406 in series with one another. At the same time, the multiplicity of connecting elements 407, 408 are electrically isolated from the at least one conductive structure 405.

The stripline sections 403, 404 disposed on the first surface F1 are arranged in a first direction R1, and the at least one second conductor section 406 disposed on a third surface F3 is arranged in a second direction R2 different from the first direction R1.

The second direction may in this case differ from the first direction by (180±90)°, or by (180±45)°, or by (180±20)°, for example be roughly opposing.

As a result of this difference in directions described above, a situation is able to be achieved whereby the stripline sections 403, 404 on the first surface F1 each have positive coupling with respect to one another, and, due to the at least one conductive structure 405, there is virtually no coupling with the at least one second conductor section 406, and a compact structure is able to be produced.

FIG. 4*b* schematically shows further possible implementations according to various exemplary embodiments of the exemplary embodiments of FIG. 4*a*.

FIG. 4*b* shows exemplary embodiments according to FIG. 4*a*, wherein two further surfaces, an outer surface Fa, which is arranged on that side of the first surface F1 facing away from the second surface F2 and comprises a second at least one conductive structure 409, and a fourth surface F4, which is arranged on that side of the third surface F3 facing away from the second surface F2 and comprises a third at least one conductive structure 410.

In various exemplary embodiments, only the outer surface Fa, only the fourth surface F4, or both the outer surface Fa and the fourth surface F4 may be present.

In the exemplary embodiments in which the outer surface Fa is present, an outer volume Va, which is delimited by the first surface F1 and the outer surface Fa, is filled with a fourth dielectric material having a permittivity ε4. In addition, the second at least one conductive structure 409 may be coupled to the at least one conductive structure on the first surface F1.

In the exemplary embodiments in which the fourth surface (F4) is present, a third volume (V3), which is delimited by the third surface (F3) and the fourth surface (F4), is filled with a third dielectric material having a permittivity ε3.

In addition, the third at least one conductive structure (410) may be coupled to the at least one conductive structure on the first surface (F1).

Figure 5A:
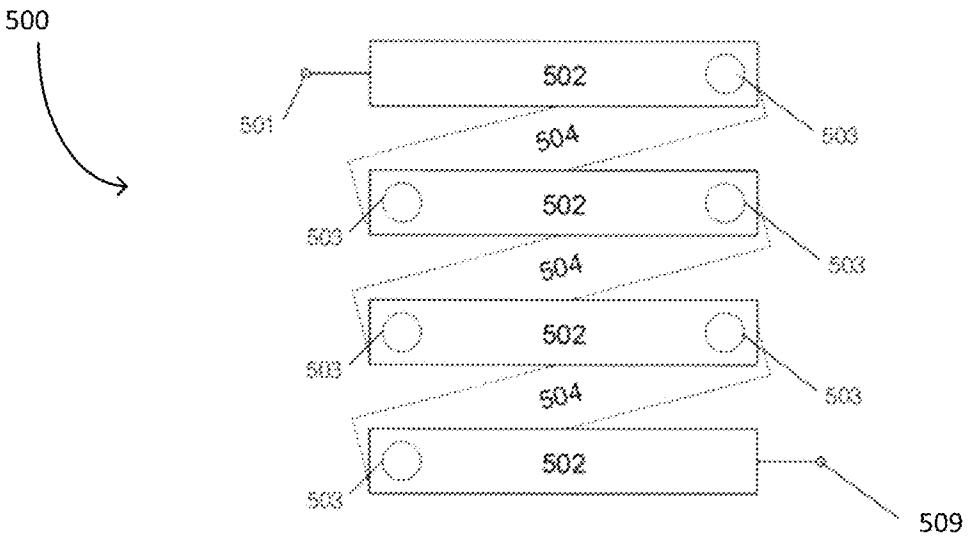
FIGS. 5*a*, 5*b* and 5*c* schematically show, in this connection, possible implementations according to various exemplary embodiments. In this case.
Figure 5B:
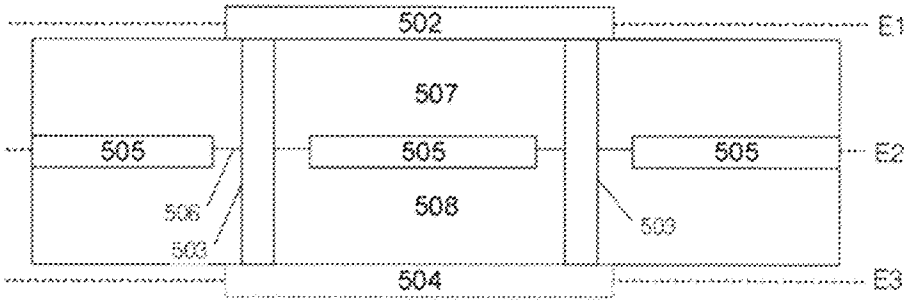
Figure 5C:
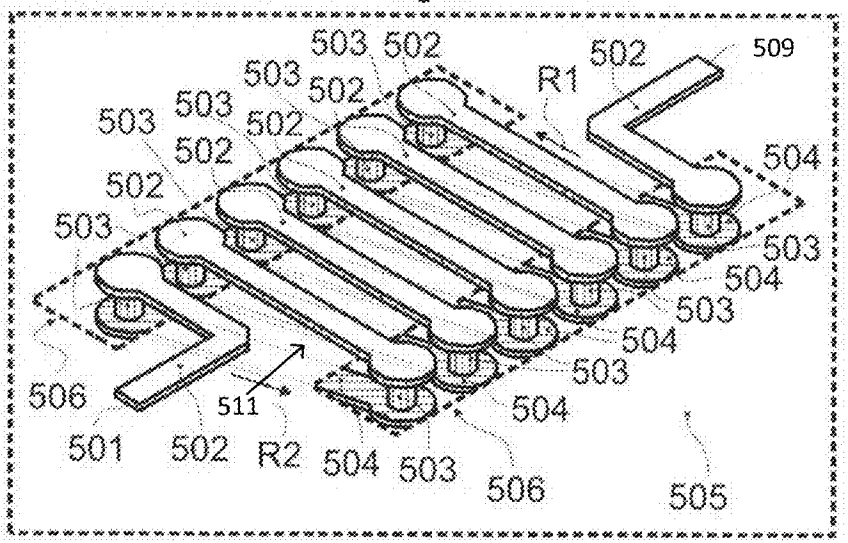

FIGS. 5*a*, 5*b* and 5*c* schematically show, in this connection, possible implementations according to various exemplary embodiments. In this case, FIG. 5*a* shows a plan view, FIG. 5*b* shows a cross-sectional view, and FIG. 5*c* shows a perspective view.

In this case, one possible implementation according to various exemplary embodiments in a plurality of planes is illustrated for example on the basis of a multilayer substrate. FIG. 5*a* and FIG. 5*b* show a schematic layout and a possible layer structure, sometimes also called a "stackup".

According to this implementation, a stripline 500 is provided, comprising a multiplicity of series-connected stripline sections 502, 504 between a first terminal 501 and a second terminal 509 as shown in FIGS. 5*a* and 5*c*. The multiplicity of stripline sections 502, 504 are arranged alternately in a first plane E1 and a third plane E3 as shown in FIG. 5*b*. The stripline sections 502 arranged in the first plane E1 belong to a first subset of the stripline sections 502, and the stripline sections 504 arranged in the third plane E3 belong to a second subset of the stripline sections 504. The stripline sections 502 align roughly in a first direction R1 as shown in FIG. 5*c*, for example with a tolerance of ±10°. Likewise, the stripline sections 504 align roughly in a second direction R2 as shown in FIG. 5C, for example likewise with tolerances of ±10°. In this case, in the example illustrated, the second direction R2 differs from the first direction R1, for example by 180°±45°. Furthermore, at least one electrically conductive section, also called "at least one electrically conductive structure" 505 (FIGS. 5*b* and 5*c*), is arranged in a second plane E2 (FIG. 5*b*). FIG. 5*b* shows, as an example, three electrically conductive structures 505. As may be seen in FIG. 5*c*, these electrically conductive structures 505 may be produced byway of a recess 506 or a plurality of recesses 506. It is for example also possible, however, to provide just the inner region 511 with a conductive structure 505. The conductive structure 505 or the conductive structures 505 may be configured for example as a stripline or as a surface.

The at least one electrically conductive structure 505 is electrically isolated from the multiplicity of stripline sections 502, 504.

A first dielectric 507 is situated between the first plane E1 and the second plane E2, and a second dielectric 508 is situated between the second plane E2 and the third plane E3 as shown in FIG. 5*b*.

The stripline sections 502 are connected in series between the first plane E1 and the third plane E3 by way of a plurality of conductive connections 503, configured as connecting elements 503 in the exemplary embodiment, and electrically isolated from the at least one electrically conductive structure 505.

In the examples illustrated, the stripline sections are configured so as to be straight. In other exemplary embodiments, the stripline sections 504, 502 may be configured so as not to be straight. By way of example, curved or undulating profiles may be used or stepped profiles may be produced using straight and/or curved elements that are arranged alternately at one or more angles with respect to one another. A common feature of the exemplary embodiments is that the coupling between the stripline sections running substantially in a first direction R1 is positive coupling. This may likewise be the case for the stripline sections running substantially in a second direction R2.

In the implementation that is described, the at least one conductive structure 505 in the second plane E2 is used both by the stripline sections in the first plane E1 and by the stripline sections in the second plane E2 as a second transmission line, as a ground surface. This may have the advantage of a simplified configuration and of a reduced requirement in terms of material. It is also possible, however, to use a plurality of planes having conductive structures that are coupled to a reference potential, to ground in some exemplary embodiments.

These implementations, according to the above exemplary embodiments, may have the advantage that the wave guidance is able to be implemented on a compact surface. The striplines 502, 504 may in each case also be configured as microstrip lines.

The properties of the positive feedback between the striplines 502 and/or 504, which are able to be described mathematically for example with the aid of coupling coefficients in each case between individual striplines 502 and/or 504, but may also be calculated in a more complex manner, for example byway of finite element methods, may be influenced by the geometric form of the individual striplines 502, 504, for example by modifying the dimensions such as length, width and height and further parameters that define the form of the stripline, such as for example the shape, which may be for example a straight, rectangular shape, a curved, a bent or a curvilinear shape or combinations of these shapes, and by the arrangements of the striplines 502 and/or 504 with respect to one another, for example the distance between the individual striplines 502 and/or 504. These properties may be designed separately for the striplines 502 and 504.

These coupling properties may be optimized for particular frequency ranges and/or signal forms in a targeted manner. For individual arrangements of stripline sections that are able to be connected in series, integrated coupling may be determined as a coupling property of the overall arrangement between a first and a second point, wherein the first and the second point may be determined for example between a first terminal and a second terminal, or else between a terminal and a connecting element.

Figure 6:
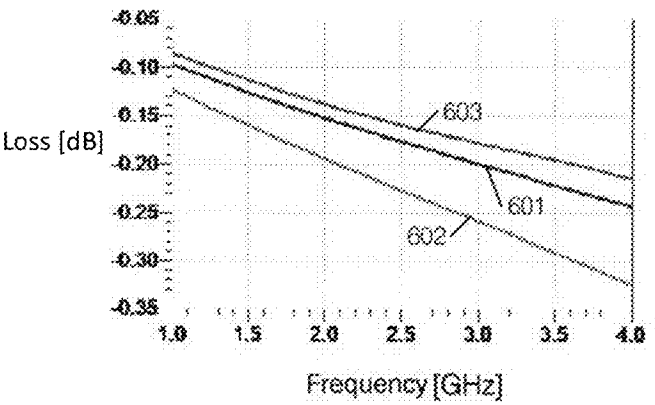
FIG. 6 shows simulation results of losses in dB as a function of frequency in GHz of comparative examples and exemplary embodiments.
Figure 7:
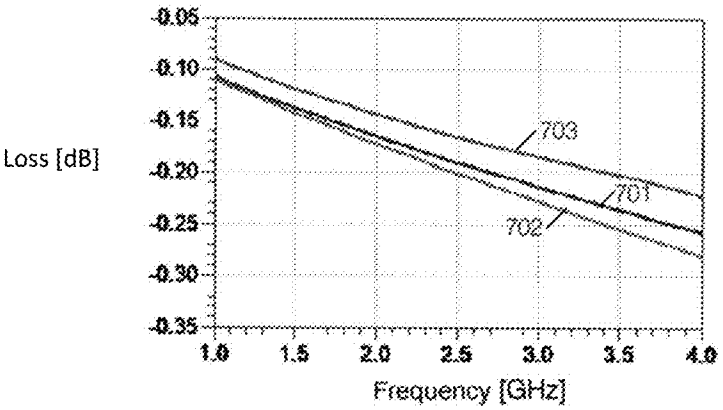
FIG. 7 shows simulation results of losses in dB as a function of frequency in GHz of comparative examples and exemplary embodiments.

FIGS. 6 and 7 show exemplary simulation results of losses in dB as a function of frequency in GHz of comparative examples and exemplary embodiments.

The loss is in each case shown as a function of frequency for various variants of transmission lines on an exemplary substrate. In each case λ/4 transmission lines having a center frequency of roughly 3.6 GHz are shown. FIG. 6 shows simulation results for a 35 ohm line, and FIG. 7 shows simulation results for a 50 ohm line.

A first curve 601 (FIG. 6), 701 (FIG. 7) shows a reference curve based on a straight stripline and in which no measures were undertaken to reduce the dimensions of the transmission line or the requirement in terms of surface.

A second curve 602 (FIG. 6), 702 (FIG. 7) shows a comparative example of a snaking/meandering transmission line, as shown for example in FIG. 3. As may be seen in FIGS. 6 and 7, the coupling effect, described above, may lead to an increase in losses in comparison with the first curve 601, 701.

A third curve 603 (FIG. 6), 703 (FIG. 7) shows simulation results for one exemplary embodiment. This may be designed for example in accordance with the implementations described with reference to FIGS. 5*a* to 5*c*. The simulation results are as the third curve 603, 703 shows the lowest losses for the calculated values.

In this case, it should be emphasized once again that the specified curves serve merely as an example with regard to both their profile forms and numerical values; depending on the choice of the distances between the conductive tracks, the profile forms may vary significantly. A greater distance between the conductive tracks thus leads to a smaller effect of the coupling, whereas a smaller distance between the conductive tracks leads to greater coupling and thus to a greater effect. It is thus also possible, in some exemplary embodiments, depending on the specific implementation, for the effects to occur to a greater or also to a lesser extent. By way of example, by changing these parameters, the system is able to be designed and optimized in line with the requirement for the specific case of application.

Figure 8:
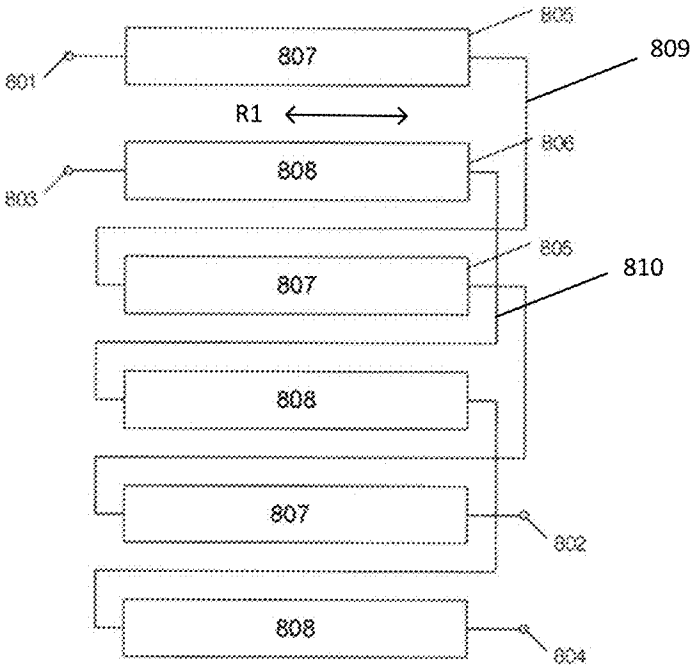
FIG. 8 schematically shows possible implementations according to various exemplary embodiments.

FIG. 8 schematically shows possible implementations according to various exemplary embodiments.

According to the exemplary embodiments that were outlined in connection with FIG. 2, FIG. 8 also shows a first transmission line, comprising a first multiplicity of series-connected striplines 807, 809, which transmission line is designed to transmit a signal, for example an RF signal, from a first terminal 801 to a second terminal 802. The first multiplicity of striplines comprises a first subset of stripline sections 807 and a second subset of stripline sections 809. FIG. 8 additionally contains a second transmission line, comprising a series-connected second multiplicity of striplines 808, 810 that comprises a third subset of stripline sections 808 and a fourth subset of stripline sections 810, which second transmission line connects a third terminal 803 to a fourth terminal 804.

Both the stripline sections 807 and the stripline sections 808 are arranged in a first direction R1. If a signal is then transmitted in one of the two transmission lines, for example the first transmission line and the corresponding line sections 807, 808, then there is electromagnetic coupling to the other transmission line, and thus for example to the second line sections 808.

According to the same principle, a second subset of stripline sections 809 may have positive coupling with a fourth subset of stripline sections 810.

Using the arrangement of the line sections, it is possible to utilize the described coupling to amplify the coupling effects. By way of example, the second line section 806 may at the same time have coupling to the two line sections 805 of the first transmission line, wherein, due to the adjacent arrangement of the line sections, the coupling of the two line sections 805 to the line section 806 is amplified.

According to these exemplary embodiments, it is possible to provide coupling between two adjacent transmission lines. This may be used for example in the case of application of a directional coupler.

Figure 9A:
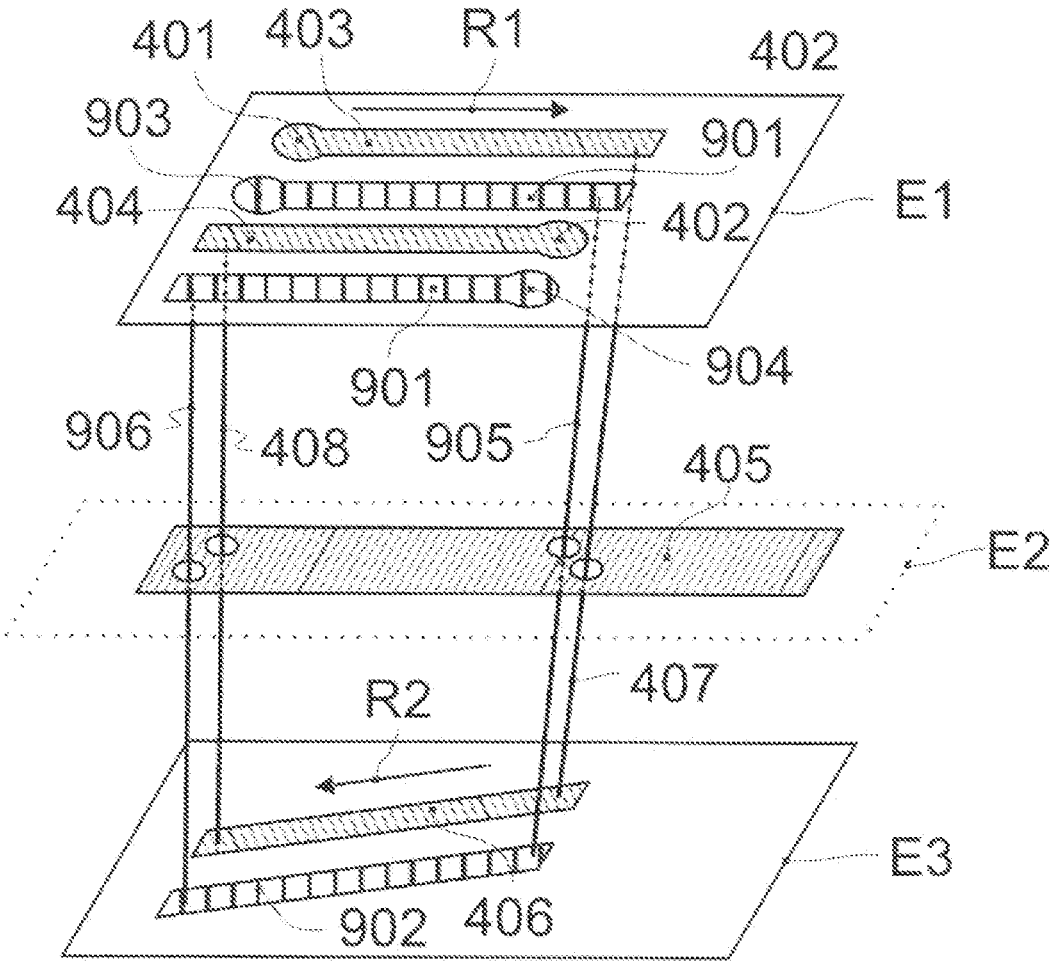
FIG. 9*a* and FIG. 9*b* schematically show possible implementations according to various embodiments.
Figure 9B:
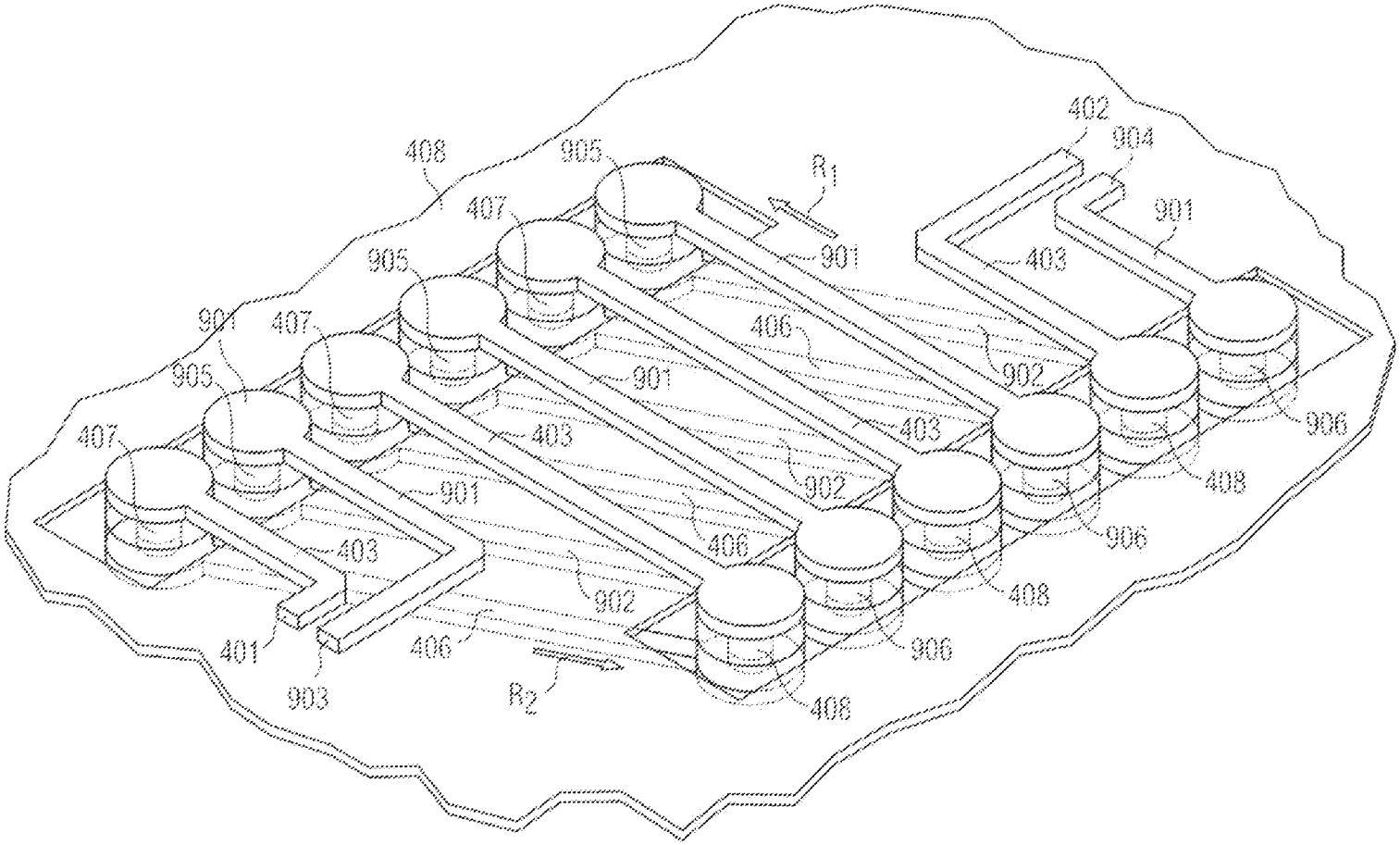

FIG. 9*a* and FIG. 9*b* schematically show possible implementations according to various embodiments.

FIG. 9*a* shows exemplary embodiments that are based on exemplary embodiments of FIGS. 4*a* and 4*b*, wherein the surfaces in FIGS. 4*a* and 4*b*, F1, F2 and F3 are configured in FIG. 9*a* as planes E1, E2 and E3, wherein E1 is an example for F1, E2 is an example for F2, and E3 is an example for F3. In addition to the structures described in connection with FIG. 4*a*, the structure shown in FIG. 9*a* has a series-connected second multiplicity of stripline sections, comprising a second multiplicity of conductor sections that may be configured as stripline sections 901 and 902, between a third terminal 903 and a fourth terminal 904, which are likewise arranged alternately in the first plane E1 and the third plane E3 and are connected by way of conductive connections, configured as connecting elements 905, 906. The striplines 901 belong to a third subset of the stripline sections, and stripline section 902 belongs to a fourth subset of the stripline sections.

In this case, the stripline sections, arranged in the first plane E1, of the second multiplicity of stripline sections 901 are oriented in a first direction R1, and the stripline sections, arranged in the third plane E3, of the second multiplicity of stripline sections 902 are arranged in a second direction R2. The directions R1 and R2 in this case correspond to the directions R1 and R2 of FIGS. 4*a* and 4*b*.

As outlined in connection with FIG. 8, the stripline sections 807 arranged in the first plane E1 have coupling with the second multiplicity of stripline sections 808.

At the same time as shown here, but also as an alternative, the stripline sections, arranged in the third plane E3, of the second multiplicity of stripline sections 902 may have coupling with the stripline sections 406, likewise arranged in the third plane E3.

As a result of the described coupling between the transmission line that connects the first terminal 401 to the second terminal 402 and the transmission line that connects the third terminal 903 to the fourth terminal 904, the device may act as a directional coupler.

FIG. 9*b* shows one possible implementation by way of a multilayer circuit board.

The directions R1 and R2, the number of substantially parallel-running tracks of the stripline sections 403, 404, 901, 406, 902 (shown for example in FIG. 9*a*) and the geometric dimensions may be changed depending on the case of application in order to achieve the desired properties of the directional coupler structure, for example amplification of the coupling between the lines.

Figure 10A:
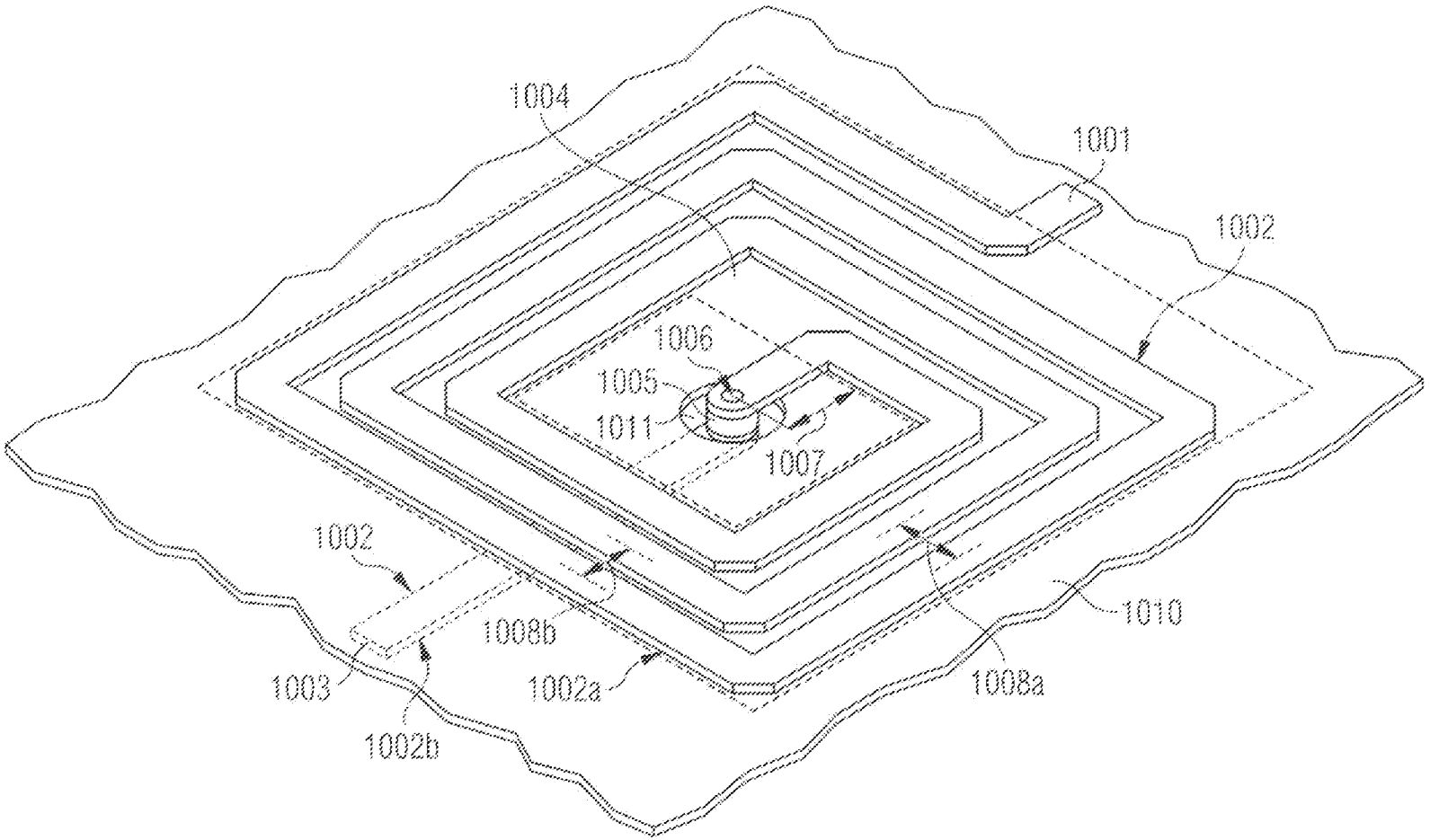
FIG. 10*a* and FIG. 10*b* schematically show possible implementations according to various embodiments.
Figure 10B:
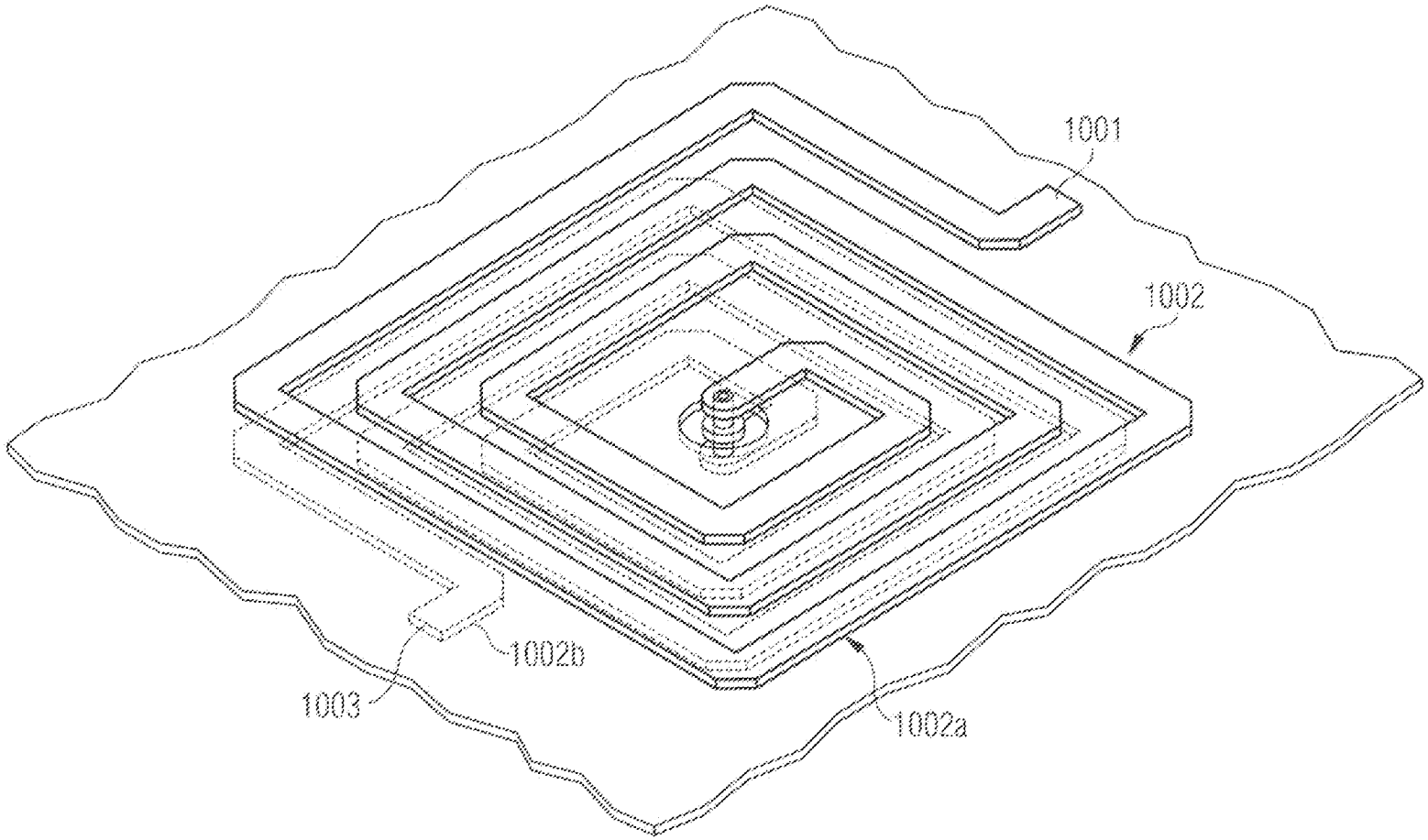

FIG. 10*a* and FIG. 10*b* schematically show possible implementations according to various embodiments.

Both FIG. 10*a* and FIG. 10*b* show a perspective view of various exemplary embodiments. A stripline 1002 runs from a first terminal 1001 to a second terminal 1003. The stripline is routed in a spiral shape in a spiral region 1004 (FIG. 10*a*).

In the present example, the spiral shape is produced by way of straight sections that have curves of substantially 90°.

Other implementations of a spiral-shaped profile, for example circular or elliptical basic forms, wherein the radius of the underlying form may change as a function of the length of the conductor section, are likewise possible. It is likewise possible to approximate a basic form using straight sections, for example a circular basic form as a polygon. A spiral may also have different variants in different regions, for example use a circular basic form in one region and use a polygon as underlying form in another region.

The stripline 1002 comprises a first subset of conductor sections 1002*a* that are situated on the first side of an electrically conductive structure 1010 (FIG. 10*a*). The electrically conductive structure 1010 has a recess 1011 (FIG. 10*a*). This recess 1011 may be present in the center of the spiral-shaped arrangement 1006 (FIG. 10*a*).

A conductive connection 1005 (FIG. 10*a*), which electrically conductively connects the first subset of conductor sections 1002*a* to the second subset of conductor sections 1002*b*, is arranged so as to pass through the recess 1011.

The spiral region 1004 may have a distance 1007, defined as the shortest distance between the spiral region 1004 and the at least one conductive connection 1005.

In the exemplary embodiments shown in FIG. 10*a* and FIG. 10*b*, the distance 1007 is greater than the distances between the stripline sections 1008*a*, 1008*b*. In other exemplary embodiments, the distance 1007 (FIG. 10*a*) may also be equal to or smaller than the distances between the stripline sections 1008*a*, 1008*b* (FIG. 10*a*). In such exemplary embodiments, the recess 1011 is not arranged in the center of the spiral-shaped arrangement 1006. In some exemplary embodiments, the distance 1007 may be zero, such that the at least one conductive connection 1005 and the recess 1011 are arranged in the spiral region 1004. In some exemplary embodiments, the spiral region 1004 also runs as far as the center of spiral-shaped arrangement 1006.

As shown in FIG. 10*b*, the second subset of conductor sections 1002*b* may likewise have a spiral-shaped profile. Due to the electrically conductive structure 1010, the first subset of conductor sections 1002*a* and the second subset of conductor sections 1002*b* are electrically decoupled. The properties of the spiral-shaped profile of the second subset of conductor sections 1002*b* are independent of the spiral-shaped profile of the first subset of conductor sections 1002*a*. By way of example, the spirals may differ in terms of their basic forms, their turns number, their center, or in terms of the design of the striplines (for example width, thickness, etc.).

Due to the conductive structure 1010, both spiral regions may be considered independently of one another, with the exception of the connection, provided by the at least one conductive connection 1005, in the middle of spiral-shaped arrangement 1006, wherein the at least one conductive connection, including outside the middle of spiral-shaped arrangement 1006, may lie for example in the spiral region 1004, for example may lie outside the spiral region 1004.

Although specific exemplary embodiments have been illustrated and described in this description, those skilled in the art will recognize that a multiplicity of alternative and/or equivalent implementations may be selected as a substitute for the specific exemplary embodiments that are disclosed and described in this description, without departing from the scope of the disclosed invention. This application is intended to cover all adaptations or variations of the specific exemplary embodiments that are discussed here. It is therefore intended for this invention to be restricted only by the claims and the equivalents of the claims.

What is claimed is:

1. A device, comprising:

at least one electrically conductive structure, at least one stripline, comprising a multiplicity of stripline sections that are connected to one another in a series connection between a first terminal and a second terminal, wherein a first subset of the stripline sections is arranged on a first side of the conductive structure, and a second subset of the stripline sections is arranged on a second side of the conductive structure, wherein the second side is different from the first side, at least one conductive connection between the first subset of the stripline sections and the second subset of the stripline sections, wherein the at least one conductive connection is isolated from the at least one electrically conductive structure, wherein the first subset of the stripline sections is arranged in a first arrangement and/or the second subset of the stripline sections is arranged in a second arrangement, such that a signal propagating from the first terminal to the second terminal has coupling integrated over the first arrangement and/or second arrangement, which coupling is positive, and wherein, with respect to the first subset of the stripline sections and/or the second subset of the stripline sections, a proportion of more than 70%, with respect to an overall length of the multiplicity of stripline sections between the first terminal and the second terminal, have the positive coupling.

2. The device as claimed in claim 1, wherein the first subset of the stripline sections is arranged on a first surface of the device, the at least one electrically conductive structure is arranged on a second surface of the device, the second subset of the stripline sections is arranged on a third surface of the device, wherein the at least one electrically conductive structure, the first subset of stripline sections, and the second subset of stripline sections provide a waveguide for signals between the first terminal and the second terminal, wherein a first volume that is delimited by the first surface and the second surface is filled with a first dielectric material, and wherein a second volume that is delimited by the second surface and the third surface is filled with a second dielectric material.

3. The device as claimed in claim 2, wherein the first surface is a first plane, the second surface is a second plane, and the third surface is a third plane.

4. The device as claimed in claim 2, wherein the at least one stripline comprises one or more microstrip lines.

5. The device as claimed in claim 2, wherein the first surface, the second surface, the third surface, the first volume and the second volume are layers of a multilayer circuit board.

6. The device as claimed in claim 2, additionally comprising:

an outer surface, which is arranged on a side of the first surface facing away from the second surface and comprises a second at least one conductive structure, wherein an outer volume that is delimited by the first surface and the outer surface is filled with a fourth dielectric material and wherein the second at least one conductive structure is electrically coupled to the at least one conductive structure on the second surface, and/or a fourth surface, which is arranged on a side of the third surface facing away from the second surface and comprises a third at least one conductive structure, wherein a third volume that is delimited by the third surface and the fourth surface is filled with a third dielectric material, and wherein the third at least one conductive structure is coupled to the at least one conductive structure on the second surface.

7. The device as claimed in claim 1, wherein each stripline section of the first subset of stripline sections is decoupled from each stripline section of the second subset of the stripline sections.

8. The device as claimed in claim 1, wherein the first subset of stripline sections comprises a first stripline section and a second stripline section, wherein the second subset of stripline sections comprises a third stripline section, and wherein the at least one conductive connection comprises a first connecting element and a second connecting element, and the first stripline section is connected to the third stripline section by way of the first connecting element, and the third stripline section is connected to the second stripline section by way of the second connecting element, wherein the first stripline section and the second stripline section have positive coupling.

9. The device as claimed in claim 1, wherein the at least one conductive connection is provided by way of at least one connecting element.

10. The device as claimed in claim 1, wherein a. the first subset of the stripline sections are oriented roughly in a first direction with a deviation of up to ±15°, and b. the second subset of the stripline sections are arranged in a second direction with a deviation of up to ±15°.

11. A mobile radio device comprising a device as claimed in claim 1.

12. The device as claimed in claim 1, additionally comprising:

a series-connected second multiplicity of stripline sections between a third terminal and a fourth terminal, which are arranged alternately on the first side and the second side of the at least one electrically conductive structure, wherein a third subset of the second multiplicity of the stripline sections are arranged on the first side, and are oriented in a first direction with a deviation of up to ±15°, and wherein a fourth subset of the second multiplicity of the stripline sections are arranged on the second side, and are arranged in a second direction with a deviation of up to ±15°, and the fourth subset of stripline sections have coupling with the second subset of stripline sections, and/or the third subset of the stripline sections have coupling with the first subset of the stripline sections.

13. The device as claimed in claim 1, wherein the arrangement of the first subset of the stripline sections and/or of the second subset of the stripline sections is a spiral-shaped arrangement in at least a spiral region.

14. The device as claimed in claim 13, wherein the at least a spiral region extends as far as a center of the spiral-shaped arrangement.

15. The device as claimed in claim 13, wherein the arrangement is configured such that the at least one conductive connection is arranged in the at least a spiral region.

16. The device as claimed in claim 13, wherein the arrangement is configured such that the at least one conductive connection is in a center of the spiral-shaped arrangement.

17. A device, comprising:

at least one electrically conductive structure, at least one stripline, comprising a multiplicity of stripline sections that are connected to one another in a series connection between a first terminal and a second terminal, wherein a first subset of the stripline sections is arranged on a first side of the at least one conductive structure, and a second subset of the stripline sections is arranged on a second side of the at least one conductive structure, wherein the second side is different from the first side, at least one conductive connection between the first subset of the stripline sections and the second subset of the stripline sections, wherein the at least one conductive connection is isolated from the at least one electrically conductive structure, wherein the first subset of the stripline sections is arranged in a first arrangement and/or the second subset of the stripline sections is arranged in a second arrangement, such that a signal propagating from the first terminal to the second terminal has coupling integrated over the first arrangement and/or second arrangement, which coupling is positive, and wherein the first subset of the stripline sections are oriented roughly in a first direction with a deviation of up to ±15°, and the second subset of the stripline sections are arranged in a second direction with a deviation of up to ±15°.

18. A device, comprising:

at least one electrically conductive structure, at least one stripline, comprising a multiplicity of stripline sections that are connected to one another in a series connection between a first terminal and a second terminal, wherein a first subset of the stripline sections is arranged on a first side of the at least one conductive structure, and a second subset of the stripline sections is arranged on a second side of the at least one conductive structure, wherein the second side is different from the first side, at least one conductive connection between the first subset of the stripline sections and the second subset of the stripline sections, wherein the at least one conductive connection is isolated from the at least one electrically conductive structure, wherein the first subset of the stripline sections is arranged in a first arrangement and/or the second subset of the stripline sections is arranged in a second arrangement, such that a signal propagating from the first terminal to the second terminal has coupling integrated over the first arrangement and/or second arrangement, which coupling is positive, and a series-connected second multiplicity of stripline sections between a third terminal and a fourth terminal, which are arranged alternately on the first side and the second side of the at least one electrically conductive structure, wherein a third subset of the second multiplicity of the stripline sections are arranged on the first side, and are oriented in a first direction with a deviation of up to ±15°, and wherein a fourth subset of the second multiplicity of the stripline sections are arranged on the second side, and are arranged in a second direction with a deviation of up to ±15°, and the fourth subset of stripline sections have coupling with the second subset of stripline sections, and/or the third subset of the stripline sections have coupling with the first subset of the stripline sections.

* * * * *